US011465199B2

(12) United States Patent
Yeo

(10) Patent No.: US 11,465,199 B2
(45) Date of Patent: Oct. 11, 2022

(54) RUNNER APPARATUS FOR PREVENTING THERMAL LOSS OF MOLTEN MATERIALS

(71) Applicant: JPS CO., LTD, Gimhae-si (KR)

(72) Inventor: Dong-Hoon Yeo, Gimhae-si (KR)

(73) Assignee: JPS CO., LTD., Gimhae-si (KR)

( * ) Notice: Subject to any disclaimer, the term of this patent is extended or adjusted under 35 U.S.C. 154(b) by 0 days.

(21) Appl. No.: 17/018,778

(22) Filed: Sep. 11, 2020

(65) Prior Publication Data

US 2021/0387254 A1 Dec. 16, 2021

(30) Foreign Application Priority Data

Jun. 12, 2020 (KR) ..... 10-2020-0071236

(51) Int. Cl.
*B22D 35/04* (2006.01)
*B22D 43/00* (2006.01)

(52) U.S. Cl.
CPC ..... *B22D 35/045* (2013.01)

(58) Field of Classification Search
CPC ..... B22D 35/00; B22D 35/04; B22D 37/00; B22D 39/00; B22D 35/045; B22D 43/00; B22D 43/004
USPC ..... 164/335, 337, 133, 136; 222/606
See application file for complete search history.

(56) References Cited

U.S. PATENT DOCUMENTS 3,303,018 A * 2/1967 Goss ..... C21C 5/567 75/443
3,780,789 A * 12/1973 Unger ..... B22D 11/049 164/420

FOREIGN PATENT DOCUMENTS

| | | |
|---|---|---|
| KR | 10-1563363 | 10/2015 |
| KR | 10-1587280 | 1/2016 |
| KR | 10-1790001 | 11/2017 |
| KR | 10-1994111 | 6/2019 |

* cited by examiner

*Primary Examiner* — Kevin P Kerns
(74) *Attorney, Agent, or Firm* — Maschoff Brennan

(57) ABSTRACT

A runner apparatus for preventing thermal loss of molten materials, wherein the runner apparatus guides the molten materials discharged from a furnace to a casting mold, including: an insulation unit providing a passage for a flow of the molten materials discharged from the furnace and lowering a thermal loss of the molten materials; a dam unit confining the insulation unit in a predetermined space thus preventing a leak and adjusting the flow of the molten materials; an outside unit forming an exterior wall covering the insulation unit; and a spread unit, disposed under the insulation unit, spreading the molten materials dropping from the dam unit and transferring the same to the casting mold.

5 Claims, 8 Drawing Sheets

RUNNER APPARATUS FOR PREVENTING THERMAL LOSS OF MOLTEN MATERIALS

CROSS-REFERENCE TO RELATED APPLICATIONS

This application claims under 35 U.S.C. § 119(a) the benefit of priority to Korean Patent Application No. 10-2020-0071236 filed on Jun. 12, 2020, the entire contents of which are incorporated herein by reference.

TECHNICAL FIELD

The present disclosure relates to a runner apparatus for preventing thermal loss of molten materials. More particularly, the present disclosure relates to a runner apparatus for preventing thermal loss of molten materials while the molten materials provided by a furnace are being poured into a casting mold.

BACKGROUND

Casting, as one of the basic metal molding methods, is used for producing a large amount of products with an identical shape. In casting, such raw materials as scraps, pig iron, ferroalloys or nonferrous metals put into a furnace are melted by heating, poured into a mold made of sand or nonmetallic materials, and then cooled down to produce final products. Herein, the forming device used in casting is called a mold, and the product made by casting is also called a casting.

That is, casting is a process wherein a molten material is poured into a mold having a desired shape, and then allowed to solidify to finally produce a metal product of a shape identical to that of the mold.

According to a research conducted by Korea Institute of Industrial Technology, in 2012, the global casting production amounts to 100.83 m tons, of which casting iron accounts for 71.8% (72.44 m tons), cast steel 11.2% (11.30 m tons), and nonferrous castings 17.0% (17.1 m tons). The total casting output of 100.83 m tons in 2012 represents a 2.2% increase from that of 2011, and a 6.0% increase from that of 2008. In 2012, the casting production in South Korea amounts to 2.44 m tons, representing the 8th place worldwide, and accounting for 2.5% of the global casting market. With a rapid growth trend in the casting industry, China took over the U.S. in 2001 to become the biggest production country, and in 2012 produced a total of 42.50 m tons accounting for 42.1% of the global market. The top 5 countries: China, U.S., India, Japan, and Germany are responsible for 74.6% of the global casting production.

A prior art patent document regarding the present subject matter is "Ferrosilicon Molding Apparatus" (Korean Registered Patent No. 10-1587280, hereinafter referred to as "Patent Document 1").

The objective of the disclosure of Patent Document 1 is to provide a ferrosilicon molding apparatus capable of producing most of the ferrosilicons used in a steelmaking process. With the objective of producing ferrosilicon used as an auxiliary casting material in a steelmaking process, a ferrosilicon molding apparatus according to the disclosure of Patent Document 1 comprises a distributor uniformly distributing molten ferrosilicon received from a feeder; an upstream sprocket and a downstream sprocket; a chain device moving in a loop by a driving device; a plurality of mold sets receiving molten ferrosilicon provided by the distributor and seated in a series by the chain device; a cooling device, disposed over the chain device, cooling down the mold sets and the ferrosilicon seated therein; a drier, disposed under the chain device, cooling down the mold sets before entering the distributor, wherein the solidified ferrosilicons in the mold sets are discharged at the upstream sprocket.

Another prior art patent document is "Manufacturing Apparatus of Ferro-silicon Wire Rod Piece and Method of Manufacturing the Same" (Korean Registered Patent No. 10-1994111, hereinafter referred to as "Patent Document 2").

The disclosure of Patent Document 2 relates to a manufacturing apparatus for producing a ferrosilicon wire rod having a size and shape suitable for input into a steelmaking process and a manufacturing method thereof. In particular, the disclosure of Patent Document 2 relates to an apparatus for manufacturing a ferrosilicon wire rod comprising: a distributor for discharging and distributing molten ferrosilicon; a transfer unit mounted on a lower side of the distributor for transferring molten ferrosilicon discharged and dispensed from the distributor in a wire form; a cooling unit mounted on the transfer unit and cooling the molten ferrosilicon wire conveyed by the transfer unit; a separation unit for separating the ferrosilicon wire material cooled by the cooling unit from the transfer unit; and a cutting unit for cutting the ferrosilicon wire separated by the separating unit to produce a ferrosilicon wire rod.

Another prior art patent document is "Melt Supply Equipment, Casting Apparatus and Casting Method" (Korean Registered Patent No. 10-1790001, hereinafter referred to as "Patent Document 3").

The disclosure of Patent Document 3 relates to a molten material supply equipment, casting apparatus and casting method, comprising: preparing a main mold flux; injecting molten steel into a mold; melting the main mold flux to produce a molten mold flux, and injecting the molten mold flux onto the molten steel, casting a casting, determining whether to add an additive depending on the casting state during the casting of the cast steel, thereby improving the quality and productivity of the cast steel.

Another prior art patent document is "Ferrosilicon Molding Method" (Korean Registered Patent No. 10-1563363, hereinafter referred to as "Patent Document 4").

The objective of the disclosure of Patent Document 4 is to provide a method for molding ferrosilicon to be used for most of the steelmaking processes. Patent Document 4 discloses a method for molding ferrosilicon to be used as an auxiliary material for a steelmaking process, comprising steps of: distributing, by a distributor, molten ferrosilicon melted by a separate furnace; casting the molten ferrosilicon distributed by the distributor into a predetermined form using mold sets moving in a series; cooling, by a cooling device, the ferrosilicon and the mold sets; discharging the ferrosilicon solidified from the mold sets; cooling, by a cooling device, the mold sets from which the ferrosilocon has been discharged; and drying, by a drier, the mold sets such that moist on the surfaces of the mold sets is removed while the mold sets being cooled down.

The prior art documents merely disclose a process of injecting molten materials such as ferrosilicon or ferromanganese into molds, so there is still a need for improving the technology for evenly injecting molten materials into molds.

And there is another need for introducing a technology for preventing cooling down of molten auxiliary materials such as ferrosilicon or ferromanganese while they are being injected into molds.

The above information disclosed in this Background section is only for enhancement of understanding of the background of the disclosure and therefore it may contain information that does not form the prior art that is already known in this country to a person of ordinary skill in the art.

PRIOR ART DOCUMENTS

Patent Documents (Patent Document 0001) Korean Registered Patent No. 10-1587280

(Patent Document 0002) Korean Registered Patent No. 10-1994111

(Patent Document 0003) Korean Registered Patent No. 10-1790001

(Patent Document 0004) Korean Registered Patent No. 10-1563363

SUMMARY

Problems to be Solved

The present disclosure is directed to a runner apparatus for preventing thermal loss of molten materials to solve the problems of the prior art as discussed supra with the features as below.

First, the present disclosure enables evenly injecting molten materials into molds.

Second, the present disclosure enables preventing thermal loss of molten materials while they are flowing into molds.

The features of the present disclosure are not limited to the above-mentioned features, and other features not mentioned herein will be clearly understood by those skilled in the art from the following description.

Method for Solving the Problem

A runner apparatus for preventing thermal loss of molten materials according to the present disclosure has the features as below to solve the above-mentioned problems.

The present disclosure relates to a runner apparatus for preventing thermal loss of molten materials, and more particularly a runner apparatus for transferring molten materials received from a furnace to molds, comprising: a passage along which the molten materials flow from the furnace to the molds; an insulation unit for preventing thermal loss of the molten materials; a dam unit for confining the insulation unit in a predetermined space while preventing a leak as well as for adjusting a flow of the molten materials; an outside unit forming an exterior wall covering the insulating unit; and a spread unit, disposed under the insulation unit, spreading and transferring the molten materials dropped from the insulation unit to casting molds.

The insulation unit of a runner apparatus for preventing thermal loss of molten materials according to the present disclosure comprises a plate, the proximal end of which is connected to the furnace, providing a predetermined space where the molten materials from the furnace flow; a particle portion, as an aggregate of a plurality of silicate particles, filling the predetermined space provided by the plate.

The particle portion of a runner apparatus for preventing thermal loss of molten materials according to the present disclosure comprises a pouring concave portion formed by the drop of the molten materials at a position of the particle portion where the molten materials drop such that the molten materials can be temporarily retained therein.

The pouring concave portion of a runner apparatus for preventing thermal loss of molten materials according to the present disclosure temporarily retains the molten materials gathered therein to prevent thermal loss of the molten materials due to reduced surface area thereof.

The particle portion of a runner apparatus for preventing thermal loss of molten materials according to the present disclosure comprises a gathering concave portion formed by the flow and weight of the molten materials at a position of the particle portion adjacent to the dam unit such that the molten materials are temporarily retained therein.

The gathering concave portion of a runner apparatus for preventing thermal loss of molten materials according to the present disclosure temporarily retains the molten materials gathered therein to prevent thermal loss of the molten materials due to reduced surface area thereof.

The dam unit of a runner apparatus for preventing thermal loss of molten materials according to the present disclosure comprises a blocking portion, disposed at the distal end of the plate, forming a partition wall confining the particle portion therein.

The dam unit of a runner apparatus for preventing thermal loss of molten materials according to the present disclosure further comprises a fence, engaged with the blocking portion, enabling adjusting a height of the partition wall as desired.

The fence of a runner apparatus for preventing thermal loss of molten materials according to the present disclosure protrudes upward from the top of the blocking portion with an adjustable height such that a volume of the molten materials temporarily confined by the fence can be adjusted as desired.

The spread unit of a runner apparatus for preventing thermal loss of molten materials according to the present disclosure comprises a filter having a perforated mesh, disposed under the insulation unit, filtering a plurality of silicate particles when the plurality of silicate particles along with the molten materials have reached the spread unit.

The outside unit of a runner apparatus for preventing thermal loss of molten materials according to the present disclosure forms an exterior wall covering the insulation unit to prevent the thermal energy radiated from the molten materials from escaping the runner apparatus, thereby maintaining the temperature inside the insulation unit.

The spread unit of a runner apparatus for preventing thermal loss of molten materials according to the present disclosure comprises a first spread portion, stacked and partially exposed under the insulation unit, forming furrows along the flowing direction of the molten materials to initially spread the molten materials dropping from the insulation unit; a second spread portion, stacked and partially exposed under the first spread portion, forming furrows in an opposite direction to those of the first spread portion to further spread the molten materials dropping from the first spread portion.

The spread unit of a runner apparatus for preventing thermal loss of molten materials according to the present disclosure further comprises a dispersing portion, stacked and partially exposed under the second spread portion, spreading the molten materials received from the second spread portion to the width direction such that the molten materials are evenly distributed into casting molds.

Effect of the Present Disclosure

The configurations of a runner apparatus for preventing thermal loss of molten materials according to the present disclosure described supra can achieve the effects as below.

First, the present disclosure enables filling each cell of the casting mold with the molten materials without gushing or flooding.

Second, the present disclosure enables preventing thermal loss of the molten materials flowing in the runner apparatus by temporarily collecting and retaining them.

Third, the present disclosure enables evenly distributing the molten materials to the casting mold by adjusting the flow of the molten materials with a dam unit.

The effects of the present disclosure are not limited to the above-mentioned effects, and other effects not mentioned herein will be clearly understood by those skilled in the art from the following description.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present disclosure, and wherein.

Figure 1:
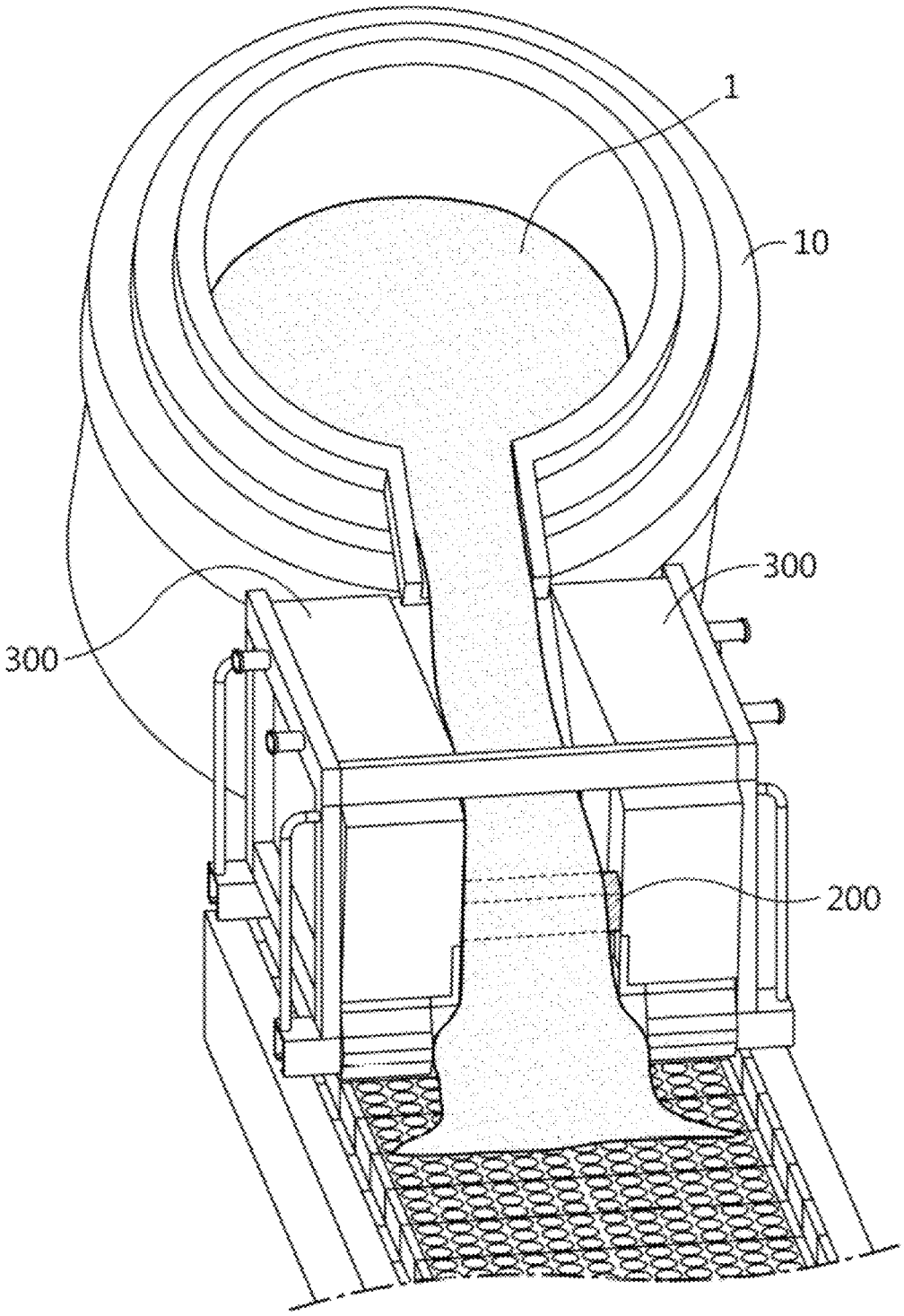
FIG. 1 is a view illustrating flowing down of molten materials to a runner apparatus for preventing thermal loss of molten materials according to the present disclosure.
Figure 2:
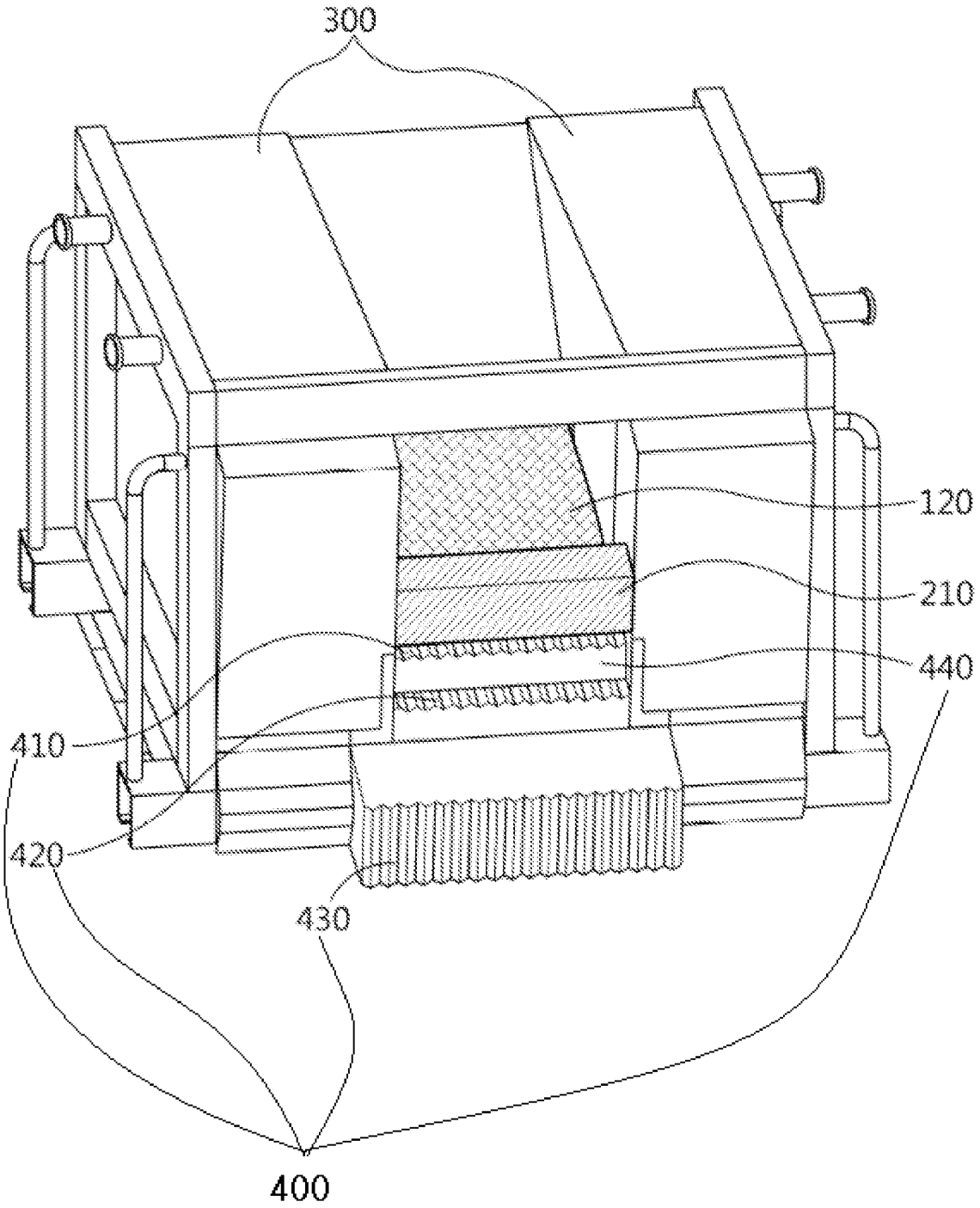
FIG. 2 is a perspective view of a runner apparatus for preventing thermal loss of molten materials according to the present disclosure.

It should be understood that the appended drawings are not necessarily to scale, presenting a somewhat simplified representation of various preferred features illustrative of the basic principles of embodiments of the disclosure. The specific design features of embodiments of the present disclosure as disclosed herein, including, for example, specific dimensions, orientations, locations, and shapes will be determined in part by the particular intended application and use environment.

In the figures, reference numbers refer to the same or equivalent parts of embodiments of the present disclosure throughout the several figures of the drawing.

DETAILED DESCRIPTION OF ILLUSTRATIVE EMBODIMENTS

Hereinafter reference will now be made in detail to various embodiments of the present disclosure, examples of which are illustrated in the accompanying drawings and described below. While the disclosure will be described in conjunction with exemplary embodiments, it will be understood that present description is not intended to limit the disclosure to those exemplary embodiments. On the contrary, the disclosure is intended to cover not only the exemplary embodiments, but also various alternatives, modifications, equivalents and other embodiments, which may be included within the spirit and scope of the disclosure as defined by the appended claims.

A runner apparatus for preventing thermal loss of molten materials according to the present disclosure, as shown in FIG. 1, is configured to produce castings of a desired unit shape by casting molten materials 1 such as ferrosilicon or ferromanganese melted in a furnace 10 in a casting mold.

Herein ferrosilicon or ferromanganese is a ferroalloy used for producing steel or cast iron; more specifically, ferrosilicon is used as deoxidizer and a reducing agent, and as a graphitizing agent for making carbon steel.

In general, casting is configured such that the molten materials 1 are poured from a furnace 10 directly onto a casting mold.

Another structure more advanced than the above is merely configured such that the molten materials 1 discharged from a furnace to flow along an elongated pipe made of refractories.

A runner apparatus for preventing thermal loss of molten materials according to the present disclosure is based on the technological ideas that gushing of the molten materials from a furnace into a focused place of the casting mold may be prevented and thermal loss of the molten materials flowing into the casting mold may be decreased.

A runner apparatus for preventing thermal loss of molten materials according to the present disclosure, as shown in FIGS. 1-4, 6, 8, and/or 9, comprises an insulation unit 100, a dam unit 200, an outside unit 300, and a spread unit 400.

Figure 3:
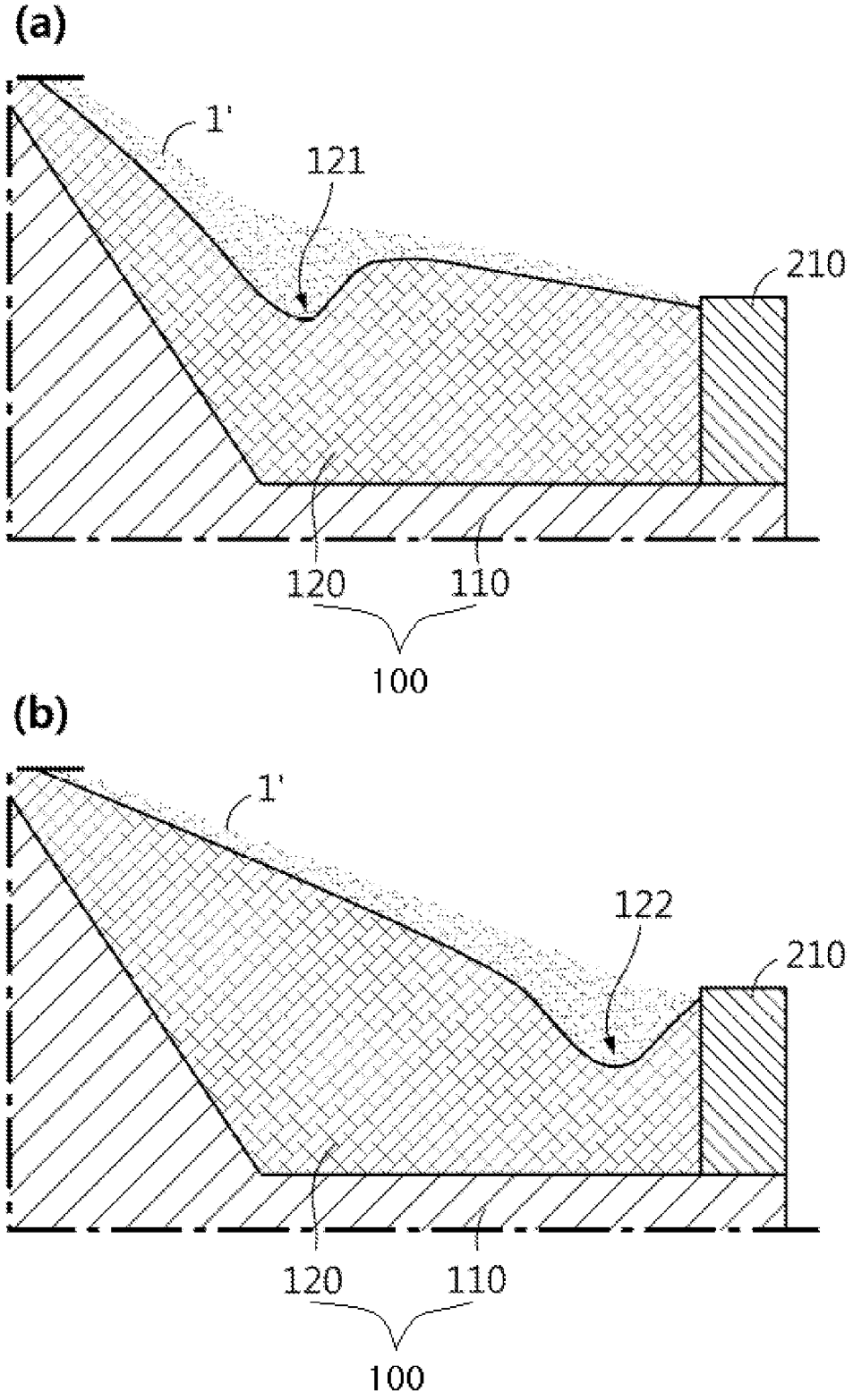
FIG. 3 is a side cross-sectional view of an insulation unit of a runner apparatus for preventing thermal loss of molten materials according to the present disclosure.
Figure 4:
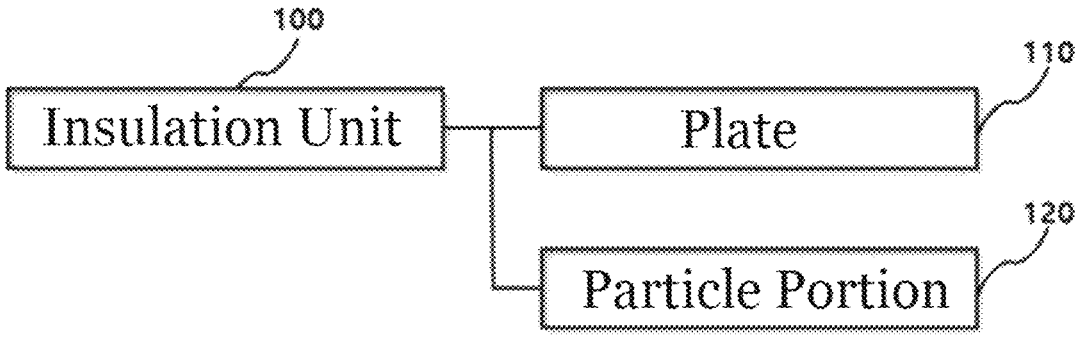
FIG. 4 is a block diagram of an insulation unit of a runner apparatus for preventing thermal loss of molten materials according to the present disclosure.

First, the insulation unit 100, as shown FIGS. 3, 4, and/or 6, is a passage along which the molten materials 1 flow from the furnace 10 and is configured to decrease the thermal loss of the molten materials 1.

The insulation unit too is a configuration which first receives the molten materials 1 from the furnace to, so it is preferably made of heat resisting and refractory materials.

Herein, the heat resisting and refractory materials are typically metals or ceramics which are resistant to decomposition by heat as high as several hundreds or thousand degrees (° C.) for a few seconds or several thousand hours.

As shown in FIG. 4, the insulation unit 100 may comprise a plate 110 and a particle portion 120.

First, the plate 110 is configured, with the proximal end thereof connected to the furnace 10, to form a predetermined space where the molten materials from the furnace 10 flow.

The plate 110 comprises two surfaces: an upper surface and a lower surface. The upper surface is configured, with its proximal end connected to the furnace, to form a steep slope such that the molten materials 1 from the furnace can quickly flow down.

The lower surface of the plate 110 may be configured to form a moderate slope or a horizontal surface.

The molten materials 1 flow from one end from the other end of the plate 110 to reach the casting mold.

The upper and lower surfaces of the plate 110 and the outside unit 300 define a predetermined space in the plate 110.

And the plate 110 is also preferably made of heat resisting and refractory materials.

The particle portion 120 is made of an aggregate of a plurality of silicate particles filling the predetermined space in the plate no.

Herein, the silicate is a rock forming mineral making up 90% of the Earth's crust and classified depending on their chemical structures including different proportions of silicon and oxygen.

The particle portion 120 is formed of silicate crushed into tiny particles, which preferably have a size of 0.063 mm~2 mm.

The particle portion comprising the plurality of silicate particles takes up a predetermined space in the plate no such that the molten materials from the furnace 10 flow over the plurality of silicate particles.

The plurality of silicate particles, having a low specific heat, are easily heated by the heat radiated from the molten materials 1, and have a high thermal insulation capacity due to their low heat conductivity.

Therefore, the plurality of silicate particles of the particle portion 120 contribute to increase of the temperature of the plate no while delaying the cooling down of the molten materials discharged from the furnace 10 by keeping the high temperature.

Figure 5:
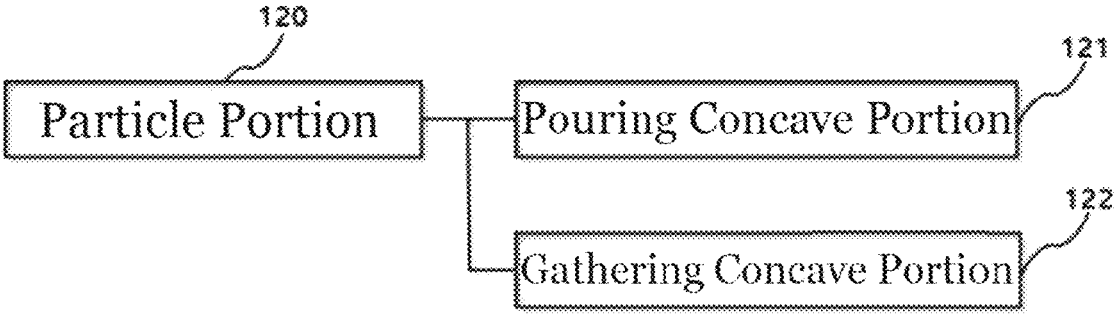
FIG. 5 is a block diagram of a particle portion of a runner apparatus for preventing thermal loss of molten materials according to the present disclosure.

As shown in FIGS. 3 and 5, the particle portion 120 comprises a pouring concave portion 121 and a gathering concave portion 122.

First, the pouring concave portion 121 is formed by the drop of the molten materials with a concave shape at a position of the particle portion 120 where the molten materials drop and are temporarily retained therein.

As shown in (a) of FIG. 3, the pouring concave portion 121 forms a place where the molten materials (1') are gathered and temporarily retained, which decreases the surface area of the molten materials thereby lowering their thermal loss.

The gathering concave portion 122 is formed, with a concave shape and at a position of the particle portion adjacent to the dam unit 200, by the flow and the weight of the molten materials 1' providing a space where the molten materials 1' are temporarily retained.

As shown in (b) of FIG. 3, the gathering concave portion 122 provides a space where the molten materials 1' are temporarily retained with a reduced surface area, thereby lowering the thermal loss of the molten materials 1'.

Figure 6:
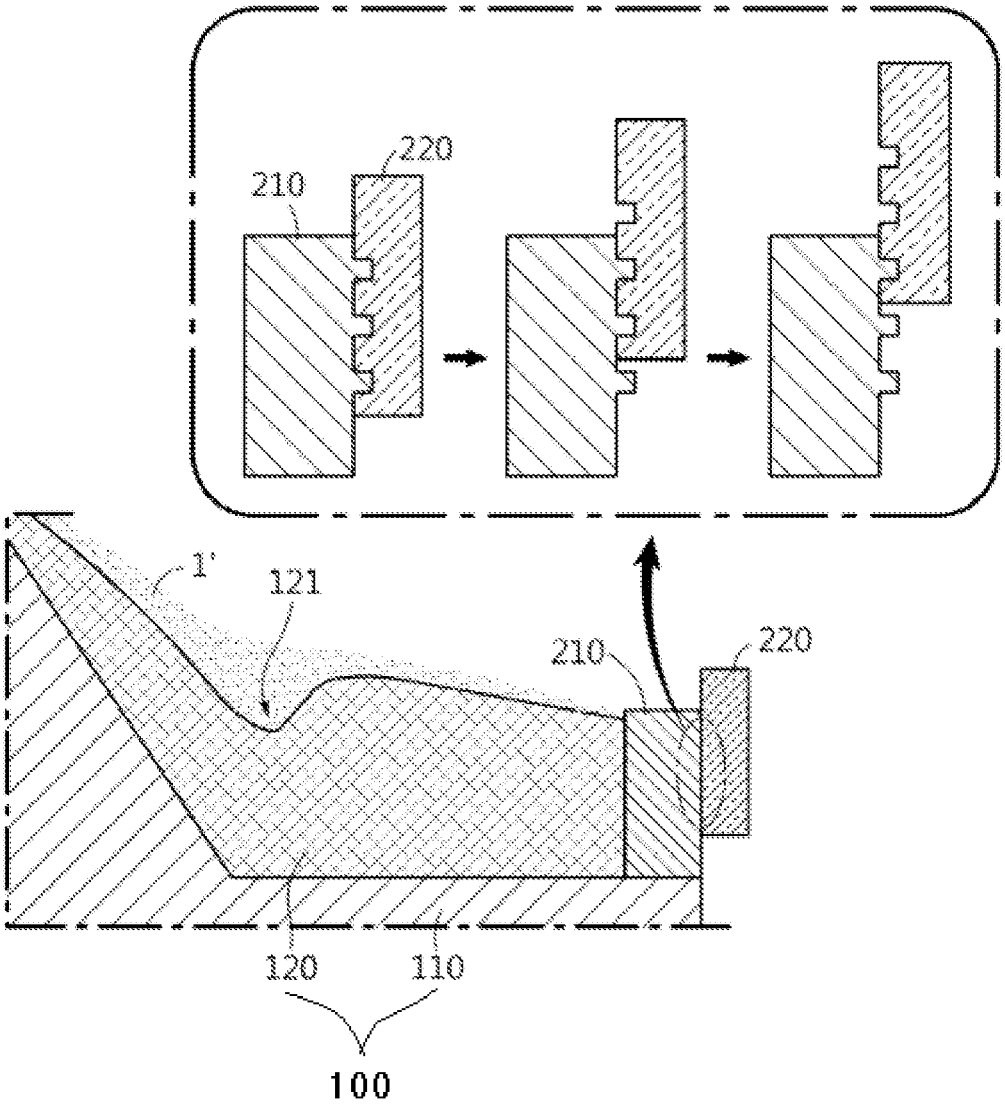
FIG. 6 is a side cross-sectional view illustrating a dam unit and height adjustment of a fence in a runner apparatus for preventing thermal loss of molten materials according to the present disclosure.

The dam unit 200, as shown in FIG. 6, is configured to confine the insulation unit 100 in a predetermined space, thus preventing a leak and adjusting the flow of the molten materials 1.

And the dam unit 200 is configured to prevent the plurality of silicate particles from escaping the particle portion 120.

Figure 7:
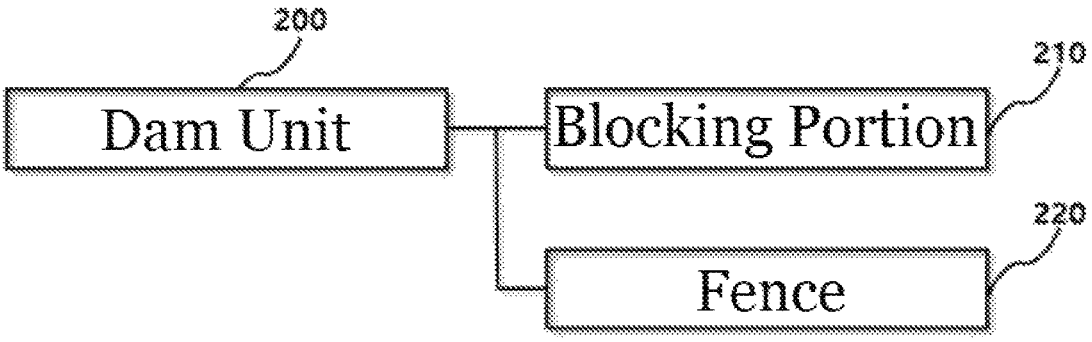
FIG. 7 is a block diagram of a dam unit of a runner apparatus for preventing thermal loss of molten materials according to the present disclosure.

The dam unit 200 of a runner apparatus for preventing thermal loss of molten materials according to the present disclosure, as shown in FIG. 7, comprises a blocking portion 210 and a fence 220.

First, the blocking portion 210, disposed at the distal end of the plate 110, forms a partition wall confining the particle portion 120 inside the plate 110.

The blocking portion 210, together with the bottom surface of the plate 110 and the outside unit 300, forms a continuous surface thus contributing to completely confining the plurality of silicate particles inside the plate no.

The blocking portion 210 forms a partition wall rising higher than the top of the heap of the plurality of silicate particles thereby preventing their overflow.

The fence 220, engaged with the blocking portion 210, is configured to adjust a height of the partition wall as desired.

As shown in FIG. 6, the fence 220 protrudes higher than the blocking portion 210 with an adjustable height, thus enabling change of a volume of the molten materials retained as desired.

The fence 220 may be engaged with, and fixed thereto, the upper part of the blocking portion 210.

For example, the blocking portion 210 may have, on its outer surface, a plurality of protrusions, which can be matched with a plurality of grooves of a corresponding shape and size formed on the fence 220.

A plurality of the grooves of the fence 220 are engaged with, and fixed thereto, the protrusions of the blocking portion 210, and the height of the fence 220 may be changed depending on the position of the engagement.

Besides, the fence 220 may be fixed to the blocking portion 210 by winding a chain. The method of fixing the fence 220 is not specifically limited and it is preferable that the fence be attached or detached as desired.

The outside unit 300 of a runner apparatus for preventing thermal loss of molten materials according to the present disclosure forms an exterior wall rising upward covering the insulation unit 100 to prevent the thermal energy radiated from the molten materials 1 from escaping the runner apparatus thereby keeping the temperature inside the insulation unit too.

The outside unit 300, as described above, is preferably made of heat resistant and refractory materials.

The outside unit 300 is preferably formed of a stack of a plurality of blocks forming most of the body of the runner apparatus.

And the outside unit 300 forms an exterior wall rising upward for the insulation unit too covering both sides thereof, thus guiding the molten materials from the furnace to to the spread unit 400.

The spread unit 400, disposed under the insulation unit 100, is configured to spread the molten materials 1 dropping from the dam unit 200 and transfer the same to the casting mold.

Figure 8:
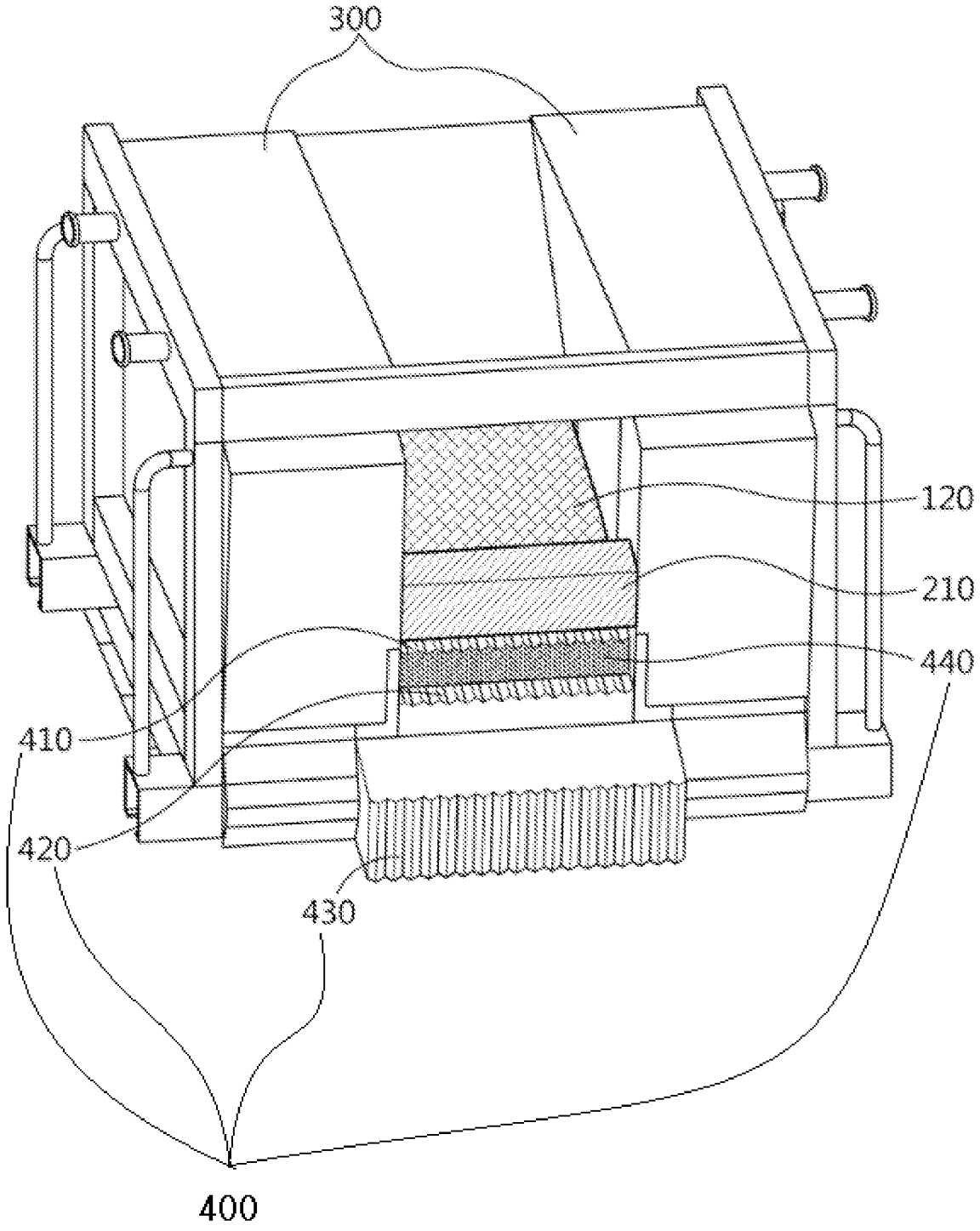
FIG. 8 is a perspective view of a filter of a runner apparatus for preventing thermal loss of molten materials according to the present disclosure.

The spread unit 400, as shown in FIG. 8, comprises furrows, preferably, such that the molten materials can be split in a lateral direction of the flow.

Figure 9:
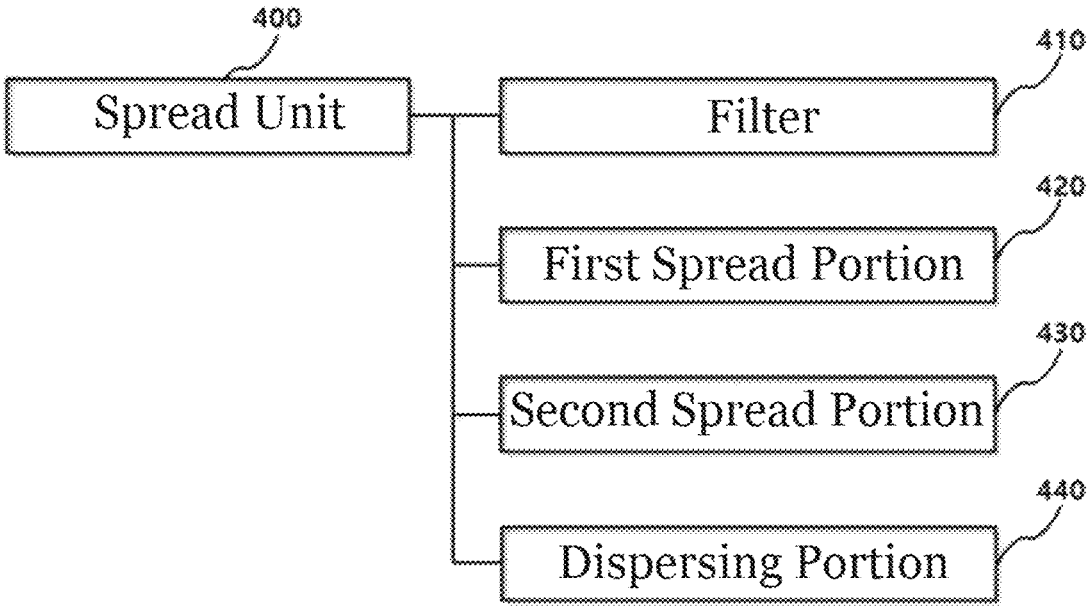
FIG. 9 is a block diagram of a spread unit of a runner apparatus for preventing thermal loss of molten materials according to the present disclosure.

The spread unit 400 of a runner apparatus for preventing thermal loss of molten materials according to the present disclosure, as shown in FIG. 9, comprises a filter 410, a first spread portion 420, a second spread portion 430, and a dispersing portion 440.

First, the filter 410, as shown in FIG. 8, as a perforated mesh disposed under the insulation unit 100, is configured to filter out the plurality of silicate particles from the mixture of the silicate particles and the molten materials 1 having reached the insulation unit 100.

The filter 410 is configured to filter out an aggregate of the plurality of silicate particles from the mixture of the plurality of silicate particles and the molten materials having reached the spread unit 400, thus preventing the silicate particles from entering into the casting mold.

A unit hole of the perforated mesh of the filter 410 may preferably have as big a diameter as can block the aggregate of a plurality of the silicate particles only from the mixture having reached the spread unit 400.

And the filter 410, as shown in FIG. 8, may be disposed under the first spread portion 420, but is not particularly limited in terms of its position.

Therefore, the filter 410 may be disposed over the first spread portion 420, or between the second spread portion 430 and the dispersing portion 440, which may be preferably determined depending on the given conditions.

The first spread portion 420, stacked and partially exposed under the insulation unit 100, is configured to provide furrows in the direction of the flow of the molten materials 1, thus initially spreading the molten materials 1 dropping from the insulation unit 100.

The second spread portion 430, stacked and partially exposed under the first spread portion, is configured to provide furrows in an opposite direction to the flow of the molten materials, thus further spreading the molten materials dropping from the first spread portion 420.

The second spread portion 430 provides furrows in an opposite direction to those of the first spread portion 420.

The dispersing portion 440, stacked and partially exposed under the second spread portion 430, is configured to spread the molten materials coming from the second spread unit in a width direction and evenly distribute the same into the casting mold.

The dispersing portion 440 is configured to have a steeper slope and a wider width than those of the second spread portion 430, thus preventing the slowing down of the flow of the molten materials 1.

That is, the dispersing portion 440 is configured to further spread the molten materials already spread by the first and second spread portions 420, 430 while speeding up the flow thereof.

The dispersing portion 440 has furrows which contribute to evenly distributing the molten materials into the casting mold by splitting the same in a lateral direction.

The scope of the present disclosure is determined by the appended claims, and the parentheses used in claims are intended not to indicate an optional limitation but to more clarify the configuration thereof; therefore any limitations in parentheses should be understood as essential to the disclosure.

The invention claimed is:

1. A runner apparatus for preventing thermal loss of molten materials, wherein the runner apparatus guides a flow of the molten materials from a furnace to a casting mold, the runner apparatus comprising:

an insulation unit providing a passage for the flow of the molten materials discharged from the furnace and lowering a thermal loss of the molten materials;

a dam unit confining the insulation unit in a predetermined space thus preventing a leak and adjusting the flow of the molten materials;

an outside unit formed of a stack of a plurality of blocks and forming an exterior wall covering the insulation unit; and a spread unit, comprising furrows such that the molten materials are split in a lateral direction of the flow, and disposed under the insulation unit, spreading the molten materials dropping from the dam unit and transferring the molten materials to the casting mold, wherein:

the insulation unit comprises:

a plate, a proximal end of which is connected to the furnace, forming a predetermined space where the molten materials discharged from the furnace flow, and a particle portion, made of an aggregate of a plurality of silicate particles, filling the predetermined space of the plate, the dam unit comprises a blocking portion, disposed at a distal end of the plate, forming a partition wall which confines the particle portion inside the plate, the dam unit comprises a fence, engaged with the blocking portion, configured to change a height of the partition wall as desired, and the blocking portion has on an outer surface of the blocking portion, a plurality of protrusions, which are matched with a plurality of grooves of a corresponding shape and size formed on the fence.

2. The runner apparatus for preventing thermal loss of molten materials of claim 1, wherein the particle portion comprises a pouring concave portion, formed by a drop of the molten materials at a position of the particle portion where the molten materials drop, where the molten materials are temporarily retained.

3. The runner apparatus for preventing thermal loss of molten materials of claim 2, wherein the pouring concave portion temporarily retains the molten materials with a reduced surface area of the molten materials, thereby lowering a thermal loss of the molten materials.

4. The runner apparatus for preventing thermal loss of molten materials of claim 1, wherein a gathering concave portion provides a space where the molten materials are temporarily retained with a reduced surface area of the molten materials, thereby lowering a thermal loss of the molten materials.

5. The runner apparatus for preventing thermal loss of molten materials of claim 1, wherein the fence, upward protruding higher than a top of the blocking portion, with an adjustable height, is configured to change a volume of the molten materials temporarily retained as desired.

* * * * *